US005771687A

United States Patent [19]

Staufenberg et al.

[11] Patent Number: 5,771,687

[45] Date of Patent: Jun. 30, 1998

[54] METHOD FOR THE CALIBRATION OF A LAMBDA PROBE IN AN INTERNAL COMBUSTION ENGINE

[75] Inventors: Ulrich Staufenberg, Diethardt; Peter Olejnik, Bad Soden, both of Germany

[73] Assignee: VDO Adolf Schindling AG, Frankfurt, Germany

[21] Appl. No.: 762,121

[22] Filed: Dec. 5, 1996

[30] Foreign Application Priority Data

Dec. 7, 1995 [DE] Germany ..... 195 45 706.4

[51] Int. Cl.[6] ..... F01N 9/00; F02D 41/14

[52] U.S. Cl. ..... 60/274; 60/276; 73/23.32; 123/694

[58] Field of Search ..... 123/693, 694; 60/274, 276, 285; 73/23.32, 118.1; 204/406, 425

[56] References Cited

U.S. PATENT DOCUMENTS

| | | | |
|---|---|---|---|
| 4,601,809 | 7/1986 | Kitahara | 123/693 X |
| 4,609,453 | 9/1986 | Shimomura | 204/425 |
| 4,751,907 | 6/1988 | Yamamoto et al. | 123/694 |
| 4,944,274 | 7/1990 | Itsuji et al. | 123/693 |
| 5,323,635 | 6/1994 | Ueno et al. | 123/694 X |
| 5,392,598 | 2/1995 | White et al. | 60/274 |

*Primary Examiner*—Tony M. Argenbright
*Attorney, Agent, or Firm*—Martin A. Farber

[57] ABSTRACT

A method for the calibration of a lambda probe in an internal combustion engine in which the lambda probe is arranged in front of and/or behind a catalytic converter in order to control a fuel-air mixture of the internal combustion engine. The lambda probe gives off signal values during a measurement period as a function of the exhaust gas produced from the fuel-air mixture. In order to compensate for the lack of sharpness resulting from a manufacturing process of the lambda probe and an aging of the probe, a method is proposed for the calibration of the lambda probe in which the catalytic converter is supplied with an overly rich fuel-air mixture. During this time the corresponding signal measurement values of the lambda probe are measured independently of other control signals. Upon a further processing of the probe signal, a correction value is formed therefrom, which correction value is fed to the probe signal in the controlled operating state of the internal combustion engine.

4 Claims, 5 Drawing Sheets

METHOD FOR THE CALIBRATION OF A LAMBDA PROBE IN AN INTERNAL COMBUSTION ENGINE

FIELD AND BACKGROUND OF THE INVENTION

The present invention relates to a method for the calibration of a lambda probe in an internal combustion engine in which the lambda probe for regulating a fuel/air mixture of the internal combustion engine is arranged in front of and/or behind a catalytic converter, the lambda probe giving off signal values during a measurement period, as a function of exhaust gas produced by the engine from the fuel-air mixture.

In order to obtain exhaust gases which are as free as possible of noxious substances, control devices for internal combustion engines are known in which the content of oxygen in the exhaust pipe is measured and evaluated. For this purpose, oxygen measurement probes are known, so called lambda probes, which operate in accordance with the principle of ionic conduction through a solid electrolyte as a result of a difference in oxygen partial pressure and, as a function of the oxygen partial pressure present in the exhaust gas, give off a voltage signal which shows a sudden change in voltage upon change from a deficiency of oxygen to an excess of oxygen, or vice versa.

The output signal of the lambda probe is evaluated by a controller which, in its turn, adjusts the fuel-air mixture via an actuator.

By the adjusting of the fuel-air ratio there is primarily desired a reduction of the injurious portions of the exhaust emission of internal combustion engines.

For correction of the signal of the lambda probe arranged in front of the catalytic converter, a second lambda probe is arranged behind the catalytic converter.

Falsifications of the output signals of the two lambda probes result in view of the fact that the probes exhibit variations as a result of the manufacturing process and that they are subject to aging upon operation.

The control circuit described above is therefore based, in many cases, on average values of the probe signals.

The average values are based on the maximum possible swing of the corresponding lambda probe. This swing, however, also changes from probe to probe as a function of the variations in the manufacturing process as well as due to the aging of the probes.

This results in a lack of sharpness for the control of the fuel-air ratio of the internal combustion engine.

SUMMARY OF THE INVENTION

It is an object of the invention to provide a method of calibrating a lambda probe which compensates for the lack of sharpness resulting from the method of manufacture and the aging of the probe.

According to the invention, the catalytic converter is provided for a certain amount of time with an overly rich fuel-air mixture and, during this period of time, corresponding signal measurement values of the lambda probe are measured independently of other control signals. Thereupon, upon further processing of the signal from the probe, a correction value is formed and is added to the probe signal in a controlled condition of operation of the internal combustion engine.

In one embodiment, an average value is formed from the maximum probe signal values measured, this average value being divided by a value or constant which corresponds to the maximum signal value of a reference probe.

In order to make certain that the catalytic converter is inactive, the measurement time is limited to a period of time which reliably prevents the catalytic converter from reaching its operating temperature.

According to a feature of the invention, the signal measurement values are measured at continuous intervals until reaching a total time $T_{MAX}$.

Further according to the invention, the measurement of the signal measurement values is effected at continuous time intervals until the operating temperature of the catalytic converter has been reached.

In one embodiment of the invention, it is directly verified whether the actual temperature of the catalytic converter is less than the operating temperature of the catalytic converter, and it is thus determined whether the catalytic converter is active or not.

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1:
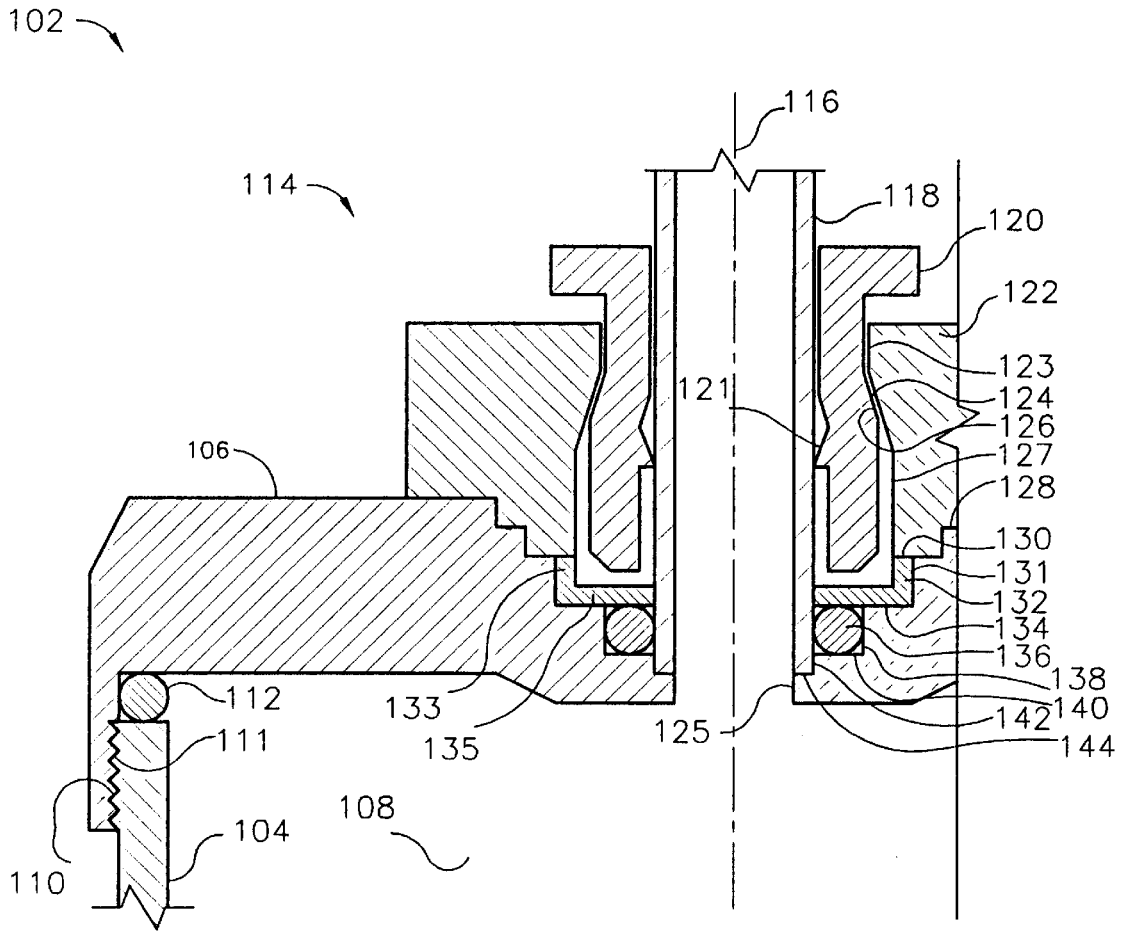
FIG. 1 is a diagram of a device for controlling the fuel-air mixture for an internal combustion engine.

In accordance with FIG. 1, in a controlled system 11, there is an internal combustion engine 1 having a catalytic converter 2. Air is fed to the engine 1 via an intake pipe 3. The fuel is injected into the intake pipe 3 via injection valves 4. Between the engine 1 and the catalytic converter 2 there is a first lambda probe 5 for detecting the engine exhaust. In the exhaust pipe behind the catalytic converter 2 there is another lambda probe 6. The lambda probes 5 and 6, respectively, measure the instantaneous lambda value of the exhaust gas in front of and behind the catalytic converter 2. Both of the signals delivered by the lambda probes 5 and 6 are conducted to a controller 8 with PI (proportional integral) characteristic, which is ordinarily arranged in a control device (not shown in detail) in the motor vehicle. The signal of the lambda probe 5 is conducted to a first control circuit 5A and to a second control circuit 6A within the controller 8. The signal of the lambda probe 6 is conducted to the second control circuit 6A.

From these signals and desired values, the controller 8 forms an actuating signal which is fed to the injection valves 4. This actuating signal results in a change in the feed of the fuel, which, together with the amount of air drawn in, results in a certain lambda value of the exhaust gas. The amount of the intake air is measured by an air quantity meter (sensor) 7.

In order now to compensate for the long-term drift of the lambda probe 5 in front of the catalytic converter 2, use is made of the second control circuit 6A which connects with the second lambda probe 6 located behind the catalytic converter 2, as will be explained further in FIG. 2.

A sign counter 14 responds via a comparator 14*a* to the difference formed at point 12 between the actual value LS6 of the second lambda probe 6 and the desired value 13 of the second lambda probe 6 only with regard to whether the sign of this difference is positive or negative. The sign counter 14 is incremented or decremented by 1 as a function of said sign.

Figure 2:
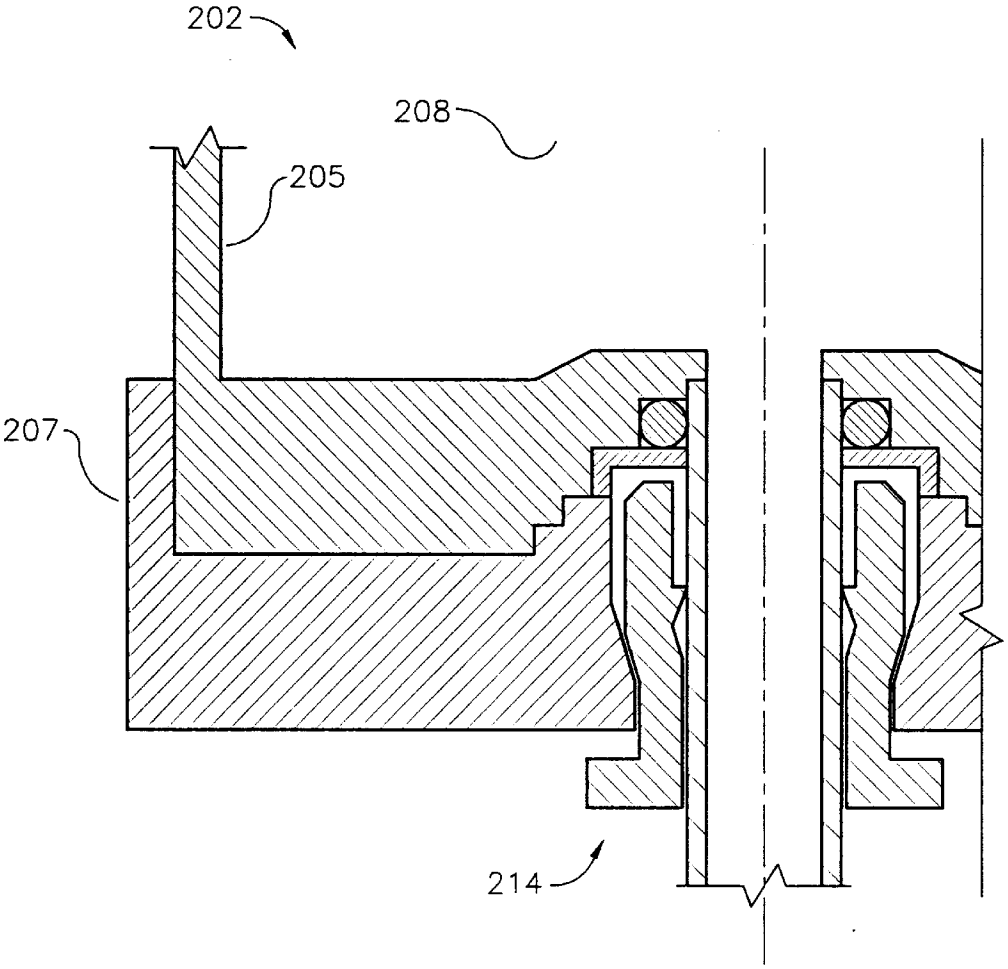
FIG. 2 is a control circuit for the lambda probe arranged behind the catalytic converter.

With reference to FIGS. 1 and 2, the lambda probe 6 arranged in the exhaust pipe behind the catalytic converter 2 supplies a lambda value in the form of a signal voltage. At the start of each control cycle, it is checked whether the probe 6 is active. This is done in a manner by which it is determined whether this signal voltage is outside of a voltage range (ULSU, ULS0) shown in FIG. 4. If so, then the actual value ($U_{6ACT}$) measured by the lambda probe 6 is compared at a summation point 12 with a reference (or set) value 13, as well as set value 9 (FIG. 1), stored in a non-volatile memory of the control device. This set value ($U_{6SET}$) is formed from the average value measured by the lambda probe 6 when the lambda probe 5, arranged in front of the catalytic converter 2, is operating free of disturbance. A sign counter 14 (operating as an accumulator), with comparator 14*a* arranged in front of it, increments by 1 when the actual value $U_{6ACT}$ is greater than the set value $U_{6SET}$. It decrements by 1 when the actual value $U_{6ACT}$ is less than the set value $U_{6SET}$. If the two values are equal, the reading of the counter 14 is not changed.

Figure 5:
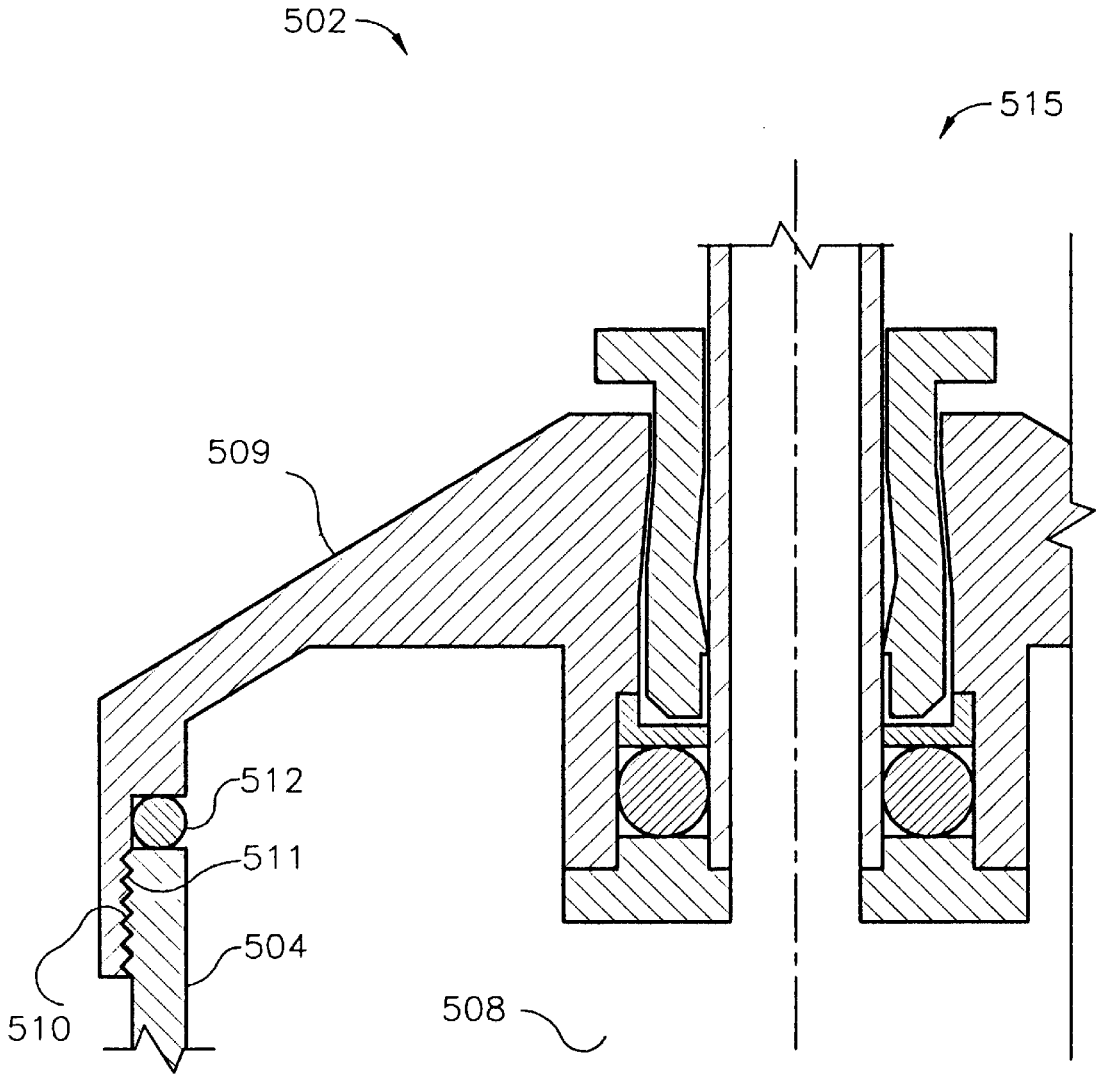
FIG. 5 is a diagram showing further details in the construction of a controller of FIG. 2.

As shown in FIG. 5, the controller 8 is a microcomputer consisting of a central processor unit (CPU), a random-access memory (RAM), and a read-only memory (ROM). The controller 8 evaluates both the signals LS5 of the first lambda probe 5 and the signals LS6 of the second lambda probe 6 which are fed to the controller 8 via its input/output unit, and processes them.

The controller 8 evaluates the signal LS5 of the first lambda probe 5 by comparing the actual value with a desired value $LS5_{SET}$ which is stored in the ROM. From this comparison, an injection time is determined as control value, whereby the fuel/air mixture is controlled. The evaluation of the second lambda circuit is superimposed on this comparison as explained in detail in connection with FIG. 2. The result of the second lambda control circuit is represented in the determination of the hold time TH. The hold time TH introduces the result that the action of the controller 8 on the injection valves 4, which takes place as a function of the comparison of the first lambda control circuit, is effected with time delay.

The controlled system 11 is in t his connection the combustion process in the engine, which is controlled via the injection time as control value and the injection valves as actuator.

The counter 14 (FIG. 2) is actuated upon each change of the signals of the lambda probe 5 arranged in front of the catalytic converter 2 and is thus clock-controlled by it.

At a first multiplication point 15, the count of the counter 14 is multiplied by a proportionality constant stored in memory 18 and having a value of (0.5–several 100) ms/probe change of the first lambda probe 5, whereby an absolute hold time $TH_{roh}$ is determined. The hold time $TH_{roh}$ thus obtained is multiplied at a second multiplication point 16 with a weighing factor WF which is located in a stored characteristic field 17 as a function of the load and of the speed of rotation n of the motor. The hold time TH thus obtained is fed as control variable to the controller 8 of the controlled system 11 for adjustment of the control system 11.

The hold time TH delays the P jump of the controller 8.

Figure 3:
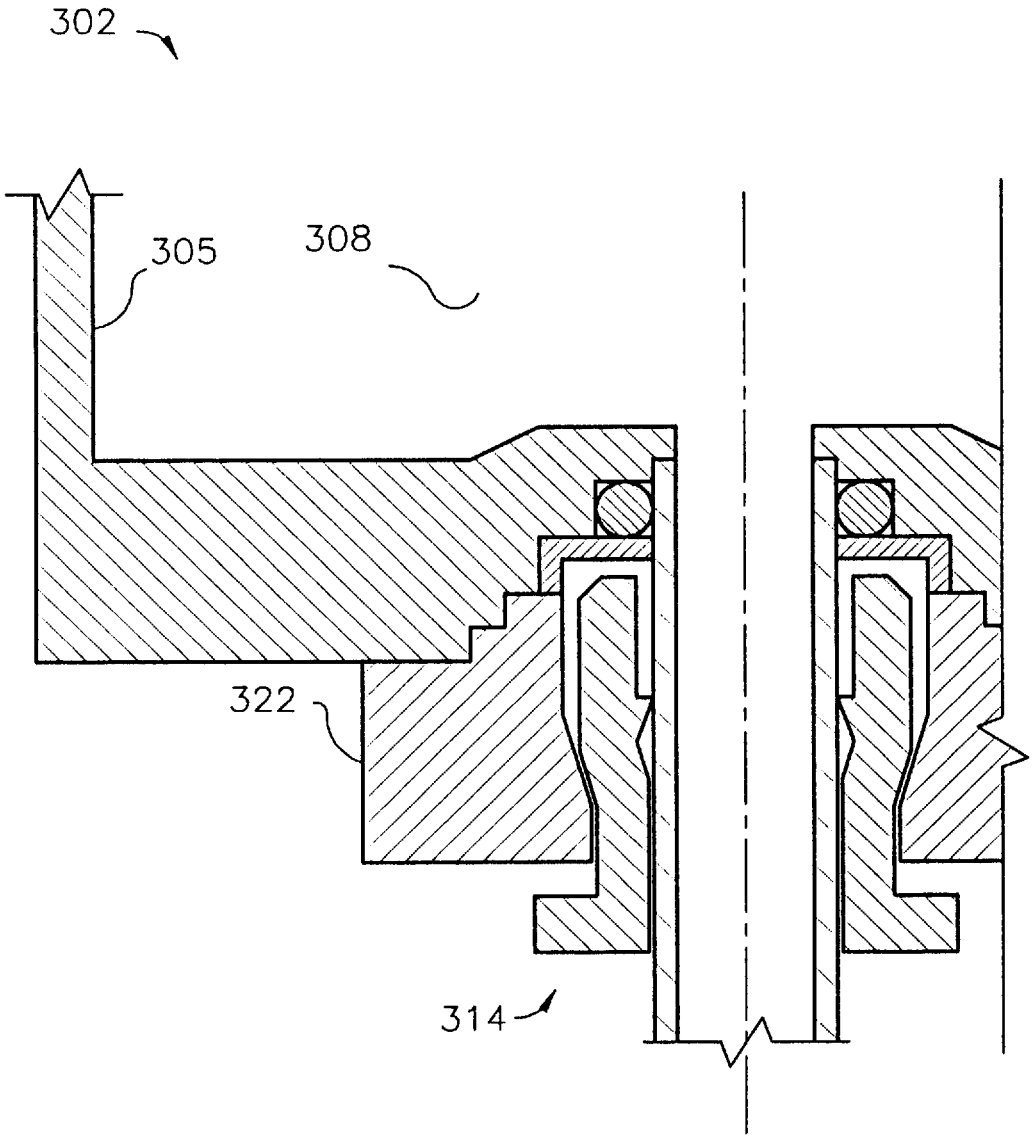
FIG. 3 comprises graphs a,b and c showing the course of the signal of the control circuits of the lambda probes in front of and behind the catalytic converter.

For better illustration, the influence of this control on the controlled system 11 is shown in FIG. 3.

In FIG. 3, the λ control factor is plotted over time.

The curves designated I (dark areas in FIG. 3*a*) show the change with time of the λ control factor without the influence of the second lambda probe control circuit 6A, while the curves designated II (hatched surface in FIG. 3*a*) show the change with time of the lambda control factor under the influence of the control circuit 6A of the second lambda probe 6 arranged behind the catalytic converter 2.

This showing is not intended to show a closed loop control circuit but serves merely to explain the action of the hold time TH on the first control circuit 5A.

The hold time TH has a sign, positive times delaying the P-jump of the controller after a lean/rich probe change, and negative times delaying the P-jump of the controller after a rich/lean probe change of the lambda probe 5 arranged in front of the catalytic converter 2.

FIG. 3*b* furthermore shows a digitalized signal which is given off by the first lambda probe 5 to the input of the controller 8. From a comparison of curves I and II, it can be seen that, under the influence of the second control circuit 6A, the duration of the pulse of the output signal of the first lambda probe 5 is lengthened. This has the result that the richness of the mixture behind the catalytic converter 2 continuously increases under the action of the second λ control circuit 6A (FIG. 3*c*).

The results of the process described are stored in the non-volatile memory of the control device and taken into account in the following control cycles.

Figure 4:
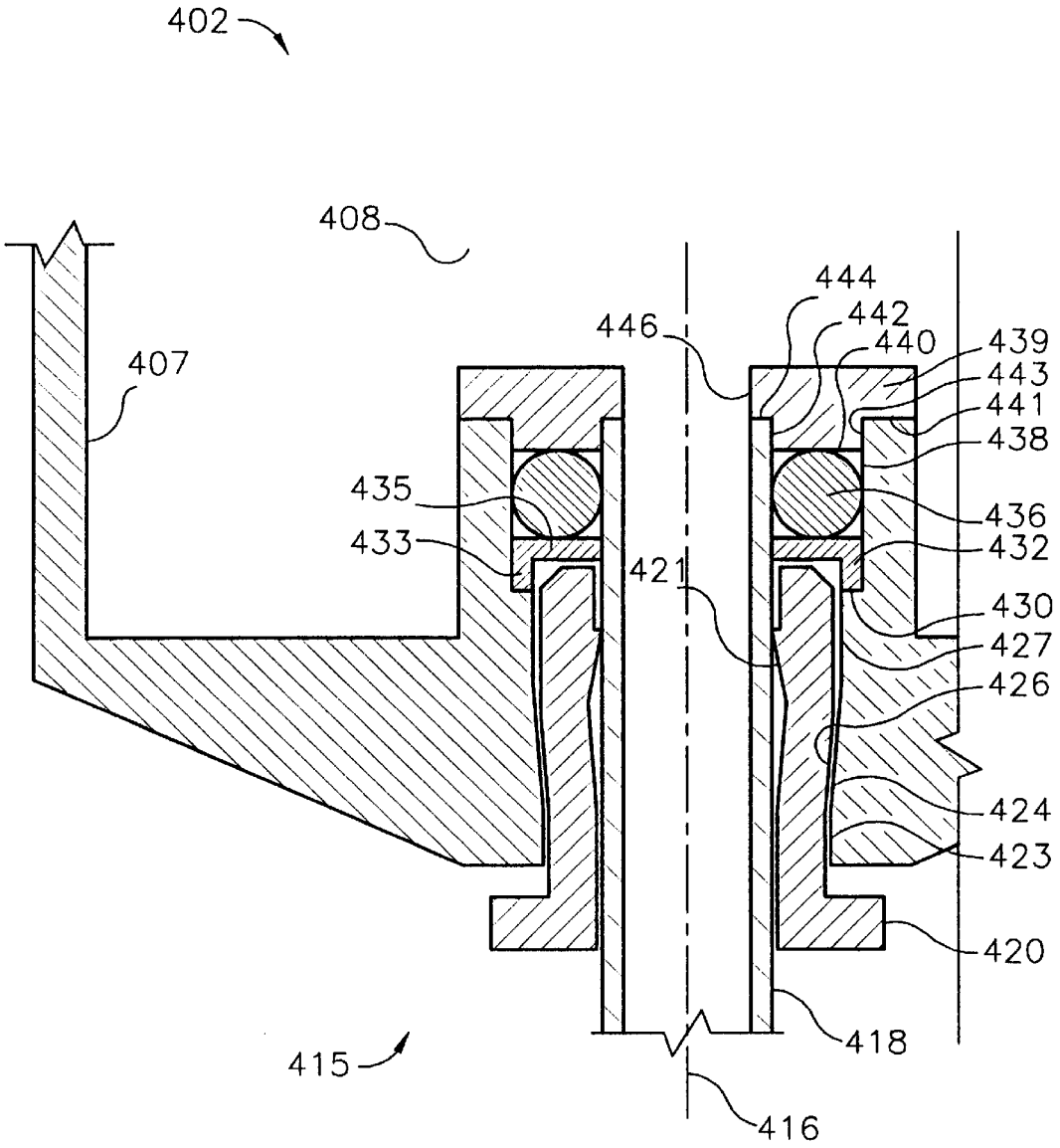
FIG. 4 shows the course of the voltage of a lambda probe over the fuel-air mixture (λ-factor)

Each lambda probe provides, via the λ factor representing the corresponding fuel-air mixture, a course of signal such as shown in FIG. 4. Depending on which type of lambda probe is used for the control, either the resistance or the voltage over the λ factor can be considered.

The following remarks refer to the signal voltage.

If the probe is active, it has a signal voltage which lies outside the region (ULSU, ULSO). During the lean deflection, the lambda probe supplies a minimum output signal which lies below ULSU. During the rich deflection a maximum voltage signal above ULSO in a range of 600–800 mV is measured. This maximum value, due to manufacturing tolerances and aging phenomena, is subject to certain dispersions which are corrected by a probe correction factor.

For the determination of the probe correction factor (10 in FIG. 1), the catalytic converter 2 is provided with an overly rich fuel-air mixture, which results in afterburning in the catalytic converter 2. A prerequisite for the determination of the probe correction factor 10 is that no control circuit (5A, 6A) is active.

The measurement time $T_{MAX}$ is about 2 minutes and can be concluded before the operating temperature of the catalytic converter 2 is reached.

During the measurement time $T_{MAX}$ the probe voltage LS6 of the lambda probe 6 arranged behind the catalytic converter 2 is measured several times at equal time intervals.

The measured values $LS6_n$ are averaged and the average value $LS6_{av}$ is stored in the random access memory (RAM).

The average value $LS6_{av}$ is divided by an applicable constant $LS_{MAX}$ which is stored in the read only memory (ROM).

This applicable constant corresponds to the maximum signal value (rich voltage value) of a reference probe.

The quotient thus determined corresponds to the probe correction factor $LS6_{CORR}$ $$LS6_{CORR} = \frac{LS6_{av}}{LS6_{MAX}}$$

The calibration value $LS6_{CORR}$ is placed in the read only memory (ROM) of the controller 8. It is used continuously during the operation of the engine and is newly formed upon a new start before the operating temperature of the engine is reached.

The determinations of the probe correction factor 10 described above are used to determine the corrected set value $U_{SETCORR}$ for the lambda probe 6 arranged behind the catalytic converter 2:

$$LS6_{SETCORR} = U6_{SET} \times LS6_{CORR}$$

The corrected desired value $U_{SETCORR}$ is determined by multiplying the desired value $U6_{SET}$ by the probe correction factor $LS6_{CORR}$.

As shown in FIG. 1, this correction is effected in the second lambda control circuit 6A where the corrected set value $U_{SETCORR}$ at the summation point 12 (FIG. 2) is compared with the actual value LS6 of the second lambda probe 6. This corrected signal thus exerts an influence on the hold time TH determined, which, as described, leads to the delaying of the p jump of the controller 8.

We claim:

1. A method for the calibration of a lambda probe in an internal combustion engine in which the lambda probe serves for regulating a fuel/air mixture of the internal combustion engine and is arranged at least one of in front of, behind, and, in front of and behind, a catalytic converter, the lambda probe giving off signal values during a measurement period, as a function of exhaust gas produced by the engine from the fuel-air mixture, the method comprising the steps of:

supplying an overly rich fuel-air mixture to the engine, the catalytic converter responding for a certain amount of time to the overly rich fuel-air mixture;

producing signal measurement values by the lambda probe;

measuring the probe signal values independently of other control signals;

processing a signal from the probe;

introducing a correction value to the probe signal based on the probe signal measurement value; and adding the correction value to the probe signal in a controlled condition of operation of the internal combustion engine.

2. A method according to claim 1, further comprising:

forming an average value from maximum measured values of probe signal; and dividing the average value by a constant based on the maximum signal value of a reference probe.

3. A method according to claim 1, wherein, in said measuring step, the signal measurement values are measured at continuous intervals until reaching a total time $T_{MAX}$.

4. A method according to claim 1, wherein, in said measuring step, the measurement of the signal measurement values is effected at continuous time intervals until operating temperature of the catalytic converter has been reached.

* * * * *